US007484695B2

(12) United States Patent
Cavalli

(10) Patent No.: US 7,484,695 B2
(45) Date of Patent: Feb. 3, 2009

(54) SWITCH MACHINE FOR RAILWAY AND TRAMWAY SWITCHES OR THE LIKE

(75) Inventor: Silvano Cavalli, Bologna (IT)

(73) Assignee: Alstom Ferroviaria S.p.A., Savigliano (IT)

( * ) Notice: Subject to any disclaimer, the term of this patent is extended or adjusted under 35 U.S.C. 154(b) by 559 days.

(21) Appl. No.: 10/545,544

(22) PCT Filed: Feb. 2, 2004

(86) PCT No.: PCT/EP2004/050070

§ 371 (c)(1),
(2), (4) Date: Aug. 12, 2005

(87) PCT Pub. No.: WO2004/074066

PCT Pub. Date: Sep. 2, 2004

(65) Prior Publication Data

US 2006/0071128 A1 Apr. 6, 2006

(30) Foreign Application Priority Data

Feb. 18, 2003 (IT) ..... SV2003A0006

(51) Int. Cl.
*E01B 7/00* (2006.01)
*B61L 5/00* (2006.01)

(52) U.S. Cl. ..... 246/415 R; 246/448; 246/449; 246/452; 246/221

(58) Field of Classification Search ..... 246/131, 246/134, 137, 138, 147, 151, 158, 218, 220, 246/221, 262, 263, 382, 449, 450, 451, 452, 246/453, 448, 415 R
See application file for complete search history.

(56) References Cited

U.S. PATENT DOCUMENTS 5,292,091 A * 3/1994 Callegari et al. ..... 246/258
5,620,156 A * 4/1997 Berggren et al. ..... 246/221

OTHER PUBLICATIONS

European Patent Office, Minutes, Oral Proceedings, Notification 04 707 237.6 (Nov. 2, 2007).

* cited by examiner

*Primary Examiner*—Mark T Le
(74) *Attorney, Agent, or Firm*—Themis Intellectual Property Counsel

(57) ABSTRACT

A switch machine for railway and tramway switches or the like, having an enclosure for its operating units of the same size as a tie and adapted to be used like a tie, characterized in that the switch machine has a modular construction.

25 Claims, 9 Drawing Sheets

SWITCH MACHINE FOR RAILWAY AND TRAMWAY SWITCHES OR THE LIKE

FIELD OF THE INVENTION

The present invention relates to a switch machine for railway and tramway switches or the like, having an enclosure for its operating units of the same size as a tie and adapted to be used like a tie.

BACKGROUND OF THE INVENTION

Switch machines for railway and tramway switches are well known and have considerable advantages.

Particularly in high speed railway lines, switches have relatively long switch points to provide such a wide radius of curvature as to withstand the high speed of the train. Unlike conventional switches, in which a switch machine is provided at the heels of the switch points and an additional switch machine is possibly provided at the frog of the switch points, high speed switches as described hereinbefore have multiple switch machines arranged all along the switch points, to keep the latter in the proper curvature condition as the train passes thereon.

Switch machines have the function of displacing switch points between two switch positions, in which one of the switch points is thrown against the corresponding rail and the other one is moved away from it. The switch point carrier units in switch machines also have latches that automatically lock the points in the thrown position as they reach said thrown position and that are moved to the point releasing condition as soon as the carrier units are actuated to move the thrown switch point away from the corresponding rail. The latches can be of the so-called trailable or non-trailable type, i.e. connections may be provided between point carrier units which allow the train to displace the points as it passes through the switch, thereby releasing said points from position locking latches. Such connections are so adjusted that the train wheels must exert a certain thrust on the switch points, e.g. when the train runs through an unswitched turnout in the direction opposite to the direction of traffic. The wheel progressively wedges between the thrown switch point and the corresponding rail and pushes the switch point away from the rail.

In the non-trailable type, the switch points are fixedly held in the thrown position so that any train passage would have the effect of damaging the carrier units or special weakened portions requiring a predetermined breaking force.

Obviously, the trailability of a switch machine requires higher construction costs; moreover, in switches with very long switch points, trailability is only required for the switch machine/s at the heels of the switch points, whereas in the intermediate portion and at the frog, given a typical train passage situation, as described above, the train wheels do not exert any thrust forces on the switch points.

Other construction parts of the switch point carrier units in the various switch machines are common and substantially identical for all switch machines.

Considering that in high speed applications each switch is required to have a large number of switch machines along its length, there is the need for minimizing switch machine fabrication costs and times.

BRIEF SUMMARY OF THE INVENTION

The present invention has the object of providing a switch machine as described hereinbefore, allowing by inexpensive arrangements a faster and more effective fabrication and limiting both fabrication and storage costs.

The present invention achieves the above object by providing a switch machine having a modular construction.

In said modular construction, one module is the enclosure, whose case part and cover part are identical or cut from an identical section, and there are further provided identical motor and transmission means and two different point locking, signaling and point coupling modules, one for the heels and other ones for the frog and the intermediate portions of the switch points.

Particularly, while separate switch point locking means are provided for each point in the critical point trailing portion, i.e. at the heels, which means that each switch point has its own point locking device, common switch point locking means for both switch points are provided at the frog and in the intermediate portions.

The joints between the motor module and the transmission module and between the point locking and coupling means and the transmission module are identical for each type of different module, so that the motor module may be dynamically connected both to the transmission module of the switch machine for the heels and to the point coupling and locking module for the intermediate portions and the frog of the switch points.

Also, the C-section case has predetermined connections for the individual modules coincident with means of the modules for fitting onto corresponding connections. This may also apply to the cover.

Modularity may be also extended to possible diagnostics or controller units, that cooperate with the mechanical units of the switch machine and that, thanks to a substantial analogy among most of the modules, are substantially identical for all switch machine types. Here, a diagnostics and controller unit may be provided that is adapted to all switch machine types and that, in switch machines for the intermediate portions and the frog of the switch points, will have more diagnostic means than required, which means may simply not be actuated. Internal modularity of diagnostic modules may be also provided for the different diagnostic units, whereby diagnostic modules may be simply adapted to the switch machine type with no additional cost associated to unused units.

The modules, either having an independent case or forming an independent member with an independent frame, but without a dedicated case, are easily fitted onto the switch machine in their proper positions. Any construction tolerances may be, for instance, compensated for by providing adjustable joints between modules or means for connection thereof to the switch machine, which allow restricted position adjustment. For example, if the modules are designed to be secured to the switch machine by bolts or the like, the through holes therefor in the case and/or frame parts of the modules or dedicated cases of the modules may have the shape of a slot or a cross (i.e. two crossed slots). Nevertheless, considering that the switch machine is preferably formed by a channel section, the relative position of the individual modules is mainly adjusted in the longitudinal direction of the switch machine, whereas the position in the transverse direction of the switch machine is defined by the side walls thereof.

The advantages of the present invention are self-evident from the above description. In fact, the different switch machine types only differ from each other in a few operating units, particularly in the transmission and point locking modules. The switch machines for the point heels and the frog have the same motor modules, the same casing and the same transmission module. The only difference lies in the different coupling and point locking modules of switch machines for the point heels and for the intermediate portions and the frog. This obviously provides a higher production effectiveness and cost reduction, for fabrication and storage or purchasing by the contractors that manufacture said operating units. Obvious advantages are also obtained in terms of maintenance and availability of spare parts. Also, as regards construction, the switch machines of this invention are easy and fast to assemble, as modularity requires simple means for unique predetermined fastening of the operating units to each other and to the housing.

The invention also relates to further improvements, as recited in the claims.

BRIEF DESCRIPTION OF THE SEVERAL VIEWS OF THE DRAWINGS

The characteristics of the invention and the advantages deriving therefrom will appear more clearly from the following description of one embodiment, which is shown by way of a non limiting embodiment in the annexed drawings, in which.

DETAILED DESCRIPTION OF THE INVENTION

Figure 1:
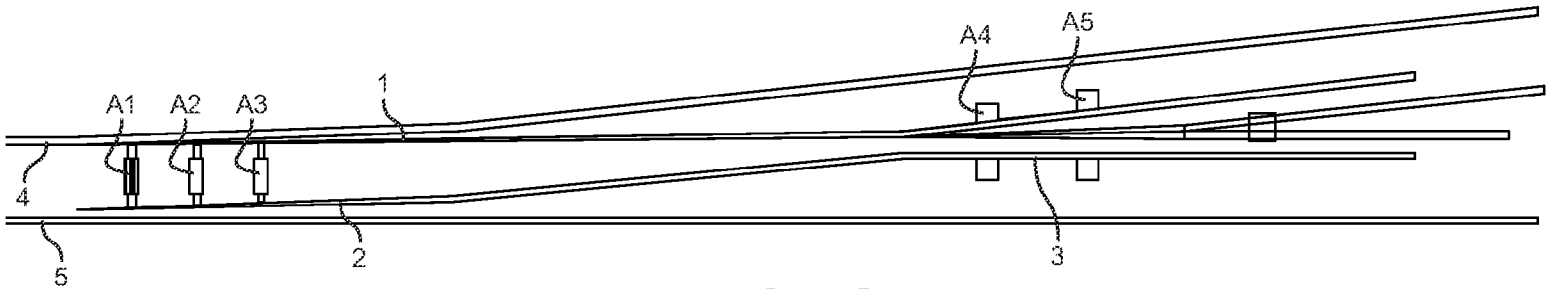
FIG. 1 is a general schematic view of a railway line segment, having a high speed switch, which comprises switch machines for the heels, switch machines for the intermediate portions and switch machines for the frog.

FIG. 1 is a schematic view of a railway line segment, which includes a switch.

The switch has a pair of switch points 1, 2, starting at a so-called frog 3 and terminating by their free ends in an intermediate position between the rails 4, 5 of a track.

In order to cause the train to divert its route from the straight track over a branch line, the switch points 1, 2 are alternately movable to a so-called thrown position, abutting against the corresponding rail. This motion is controlled by so-called switch machines. The switch as shown in FIG. 1 has long switch points, as is preferably used in high speed lines. To this end, in order to ensure a better motion of the two switch points between the two opposed thrown positions, multiple switch machines are provided, the main switch machine, denoted A1, being at the free heel of the points, one or more intermediate switch machines A2, A3, being arranged along the points 1, 2, between the main switch machine A1 and the frog 3 of the switch and one or more switch machines A4, A5 being located at the frog 3 of the switch.

The main switch machine A1 is located at the transverse axis of the track, which substantially passes through the contact points between the switch points 1, 2 and the corresponding rails 4 and 5 in the two different thrown positions.

All the switch machines typically have an actuating motor, means for transmitting and/or transforming the motion produced by the motor into a rectilinear point throwing motion, means for coupling the motion transmitting/transforming means to the points, e.g. bars or tie rods or combinations of bars or tie rods, which are dynamically connected to the output of motion transmitting/transforming means on one side and to the corresponding switch point on the other side.

Also, switch machines typically have automatic means for locking the points in the thrown position, which means are automatically releasable when the machine is actuated to move the points from a starting thrown position to the opposing thrown position. Typically, point locking means are driven into the released condition by the translational motion of point coupling means of the means for transmitting/transforming the motion produced by the motor. These means are known in the special railroad jargon as switch point locks.

These means have substantially always the same functions, and this allows the production of modular switch machines.

Figure 2:
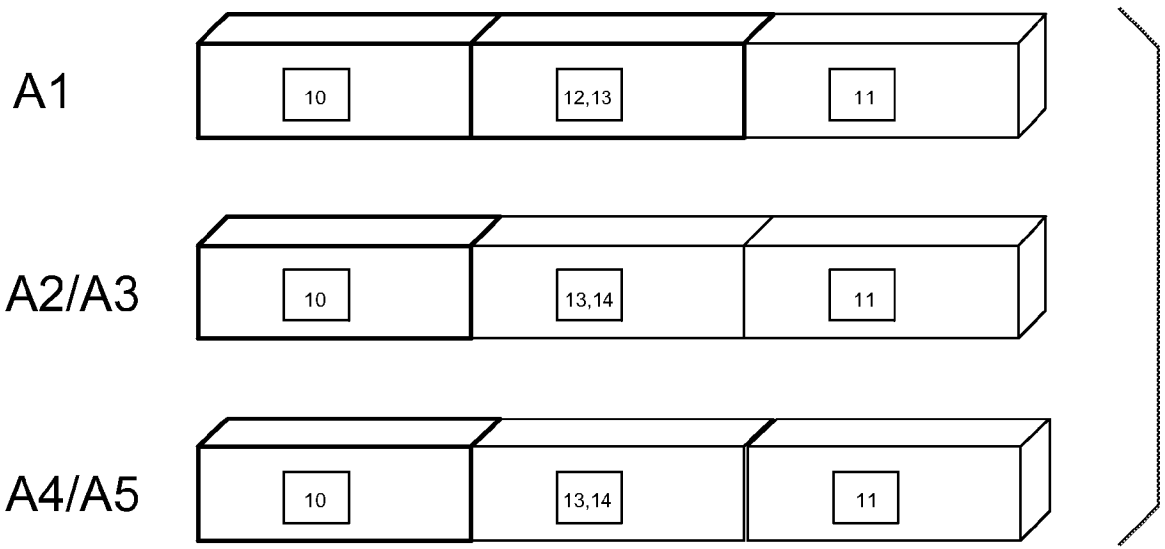
FIG. 2 is a schematic view of the modular structure of the different types of switch machines, showing the common modules, with reference to the operating characteristics.

FIG. 2 shows three different types of switch machines, i.e. the main switch machine A1, the intermediate switch machines A2 and the switch machines associated to the switch frog A4 and A5.

In FIG. 2, the switch machines A1 to A5 are formed by general operating units or modules, which correspond to the different means that form the individual switch machines, as described above.

As a rule, the main switch machine has a motor and means for transmitting/transforming the motion produced by the motor, as well as point coupling and point lock means. Further, this switch machine may have an additional module, which constitutes the controller and/or diagnostics module.

The intermediate switch machines, as well as those associated to the switch frog, have the same modules as the main machine. However, the transmission means, as well as the point coupling and the point lock means in the intermediate regions and at the frog do not require the same construction and functional safety features as the main switch machine A1. Therefore, the motion transmitting/transforming module, as well as the point coupling and point locking module have different reference numbers 13, 14, to show their construction difference from the same modules in the main switch machine, denoted 12, 13.

The motor modules, denoted 10, are identical in all switch machines A1 through A5. Regarding the controller and diagnostics module, denoted 11, this may be identical in all switch machines or have itself a special modular construction, to allow the manufacture of dedicated versions for particular types of switch machines, when this is necessary or advantageous in terms of fabrication costs.

The greater functional difference between switch machines lies in the modules 12, 13 and 13, 14, which require special different constructions, while having the same functions.

In fact, while in the main switch machine it is critical for the switch point thrown from time to time against the corresponding rail to be locked in this thrown position in the mechanically safest manner, as the point heels are the parts that actually deviate the direction of the rolling stock running through the switch, this need is not felt for the intermediate switch machines and the switch frog.

Also, since the intermediate and the frog switch machines are not designed to cooperate with the most critical area for train deviation, that is the point heels, there is no need for them to have dedicated switch point lock features for each pair of point 1, 2 and rail 4, 5. Hence, these intermediate and frog switch machines may be further simplified, thereby reducing the overall railway system costs. As is better explained hereafter with reference to that detailed description of the construction embodiment, these differences consist in that the switch point lock unit is dedicated and located at each point for the main switch machine associated to the point heels, whereas said switch point lock unit is shared by the two points and located in an intermediate position therebetween, for intermediate switch machines and/or for those associated to the switch frog.

Figure 3:
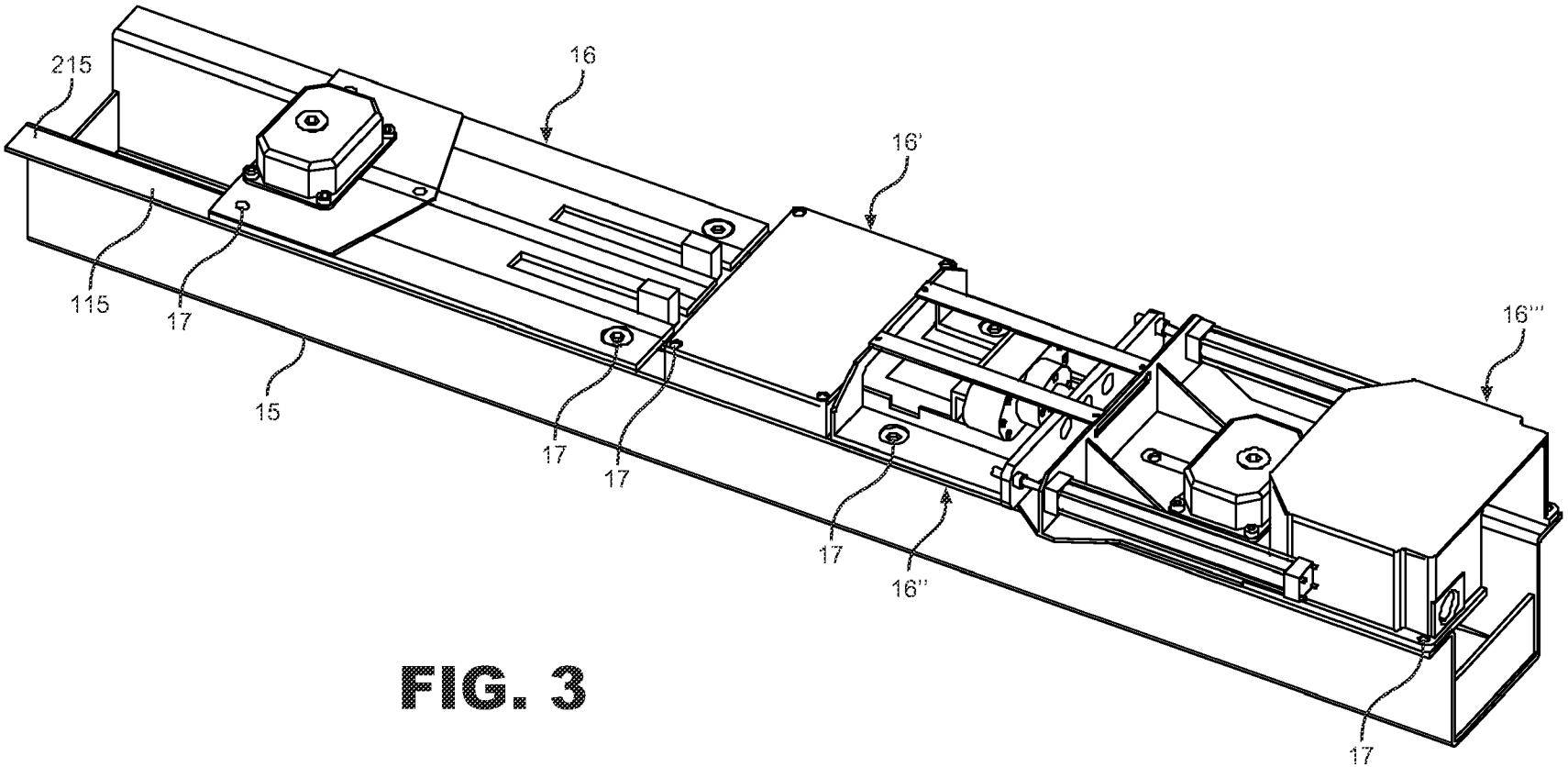
FIG. 3 is a perspective view of an open switch machine according to this invention.

FIG. 3 is a basic, perspective view of a switch machine embodiment, according to the principle of this invention.

Figure 4:
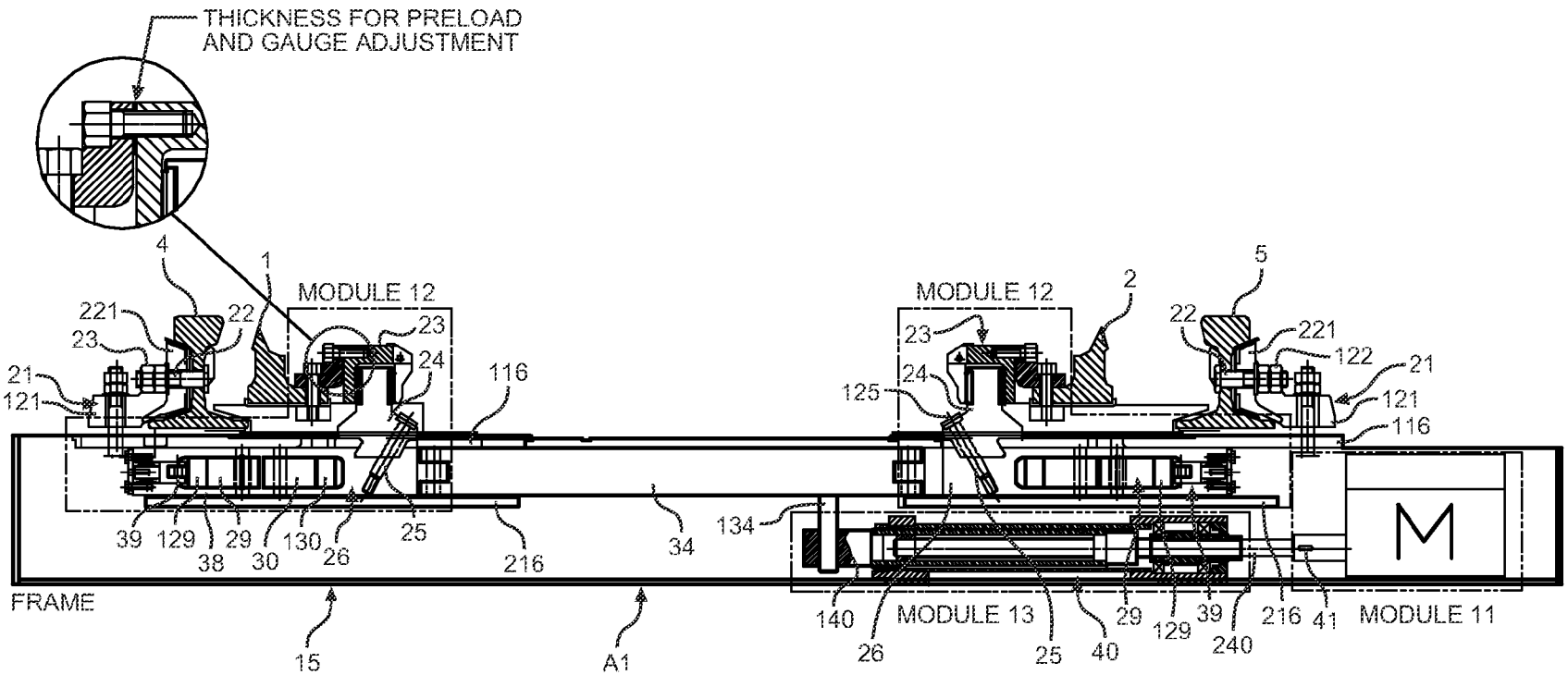
FIG. 4 is a cross sectional view of the switch machine for the heels, in which dashed and dotted lines outline the operating units which form the switch machine.

As is apparent from the figure, the switch machine is formed by a case element 15, consisting of a channel section having a substantially rectangular section with lateral longitudinal flanges 115. The lateral longitudinal flanges have holes 215 allowing the different operating units, or modules, to be fastened thereon, which modules include motor means, means for transmitting/transforming the motion produced by the motor and switch point coupling and locking means. These units or modules, designated by M in FIG. 4, are in turn preferably housed in separate cases or frames 16, 16", 16''', which also have holes 17 at predetermined positions, coinciding with the holes 215 of the channel-shaped case. In FIG. 3, the modules 16 are fitted in a predetermined position with reference to the channel case 15, and to the other modules 16, by fastener means that are not shown in detail, e.g. simple bolts, at coincident through holes 215 of the channel case 15 and 17 of the modules 16.

FIG. 3 also shows an advantageous characteristic of the invention, consisting in that at least a portion of the upper cover of the channel case 15 is formed by the upper cover of the modules 16. Other portions of the cover of the channel case 15, which provide access to means or operating units closer to the bottom of the channel case 15 are closed by special covers, denoted 16' in FIG. 3. This allows a further simplification of the construction of the switch machine. Regarding the arrangement of the modules in the embodiment as shown in FIG. 3, the module 16 and the module 16" include the switch point coupling and locking means. The cover 16' provides access to an intermediate point operating rod, which connects the point coupling and locking means to motion transmitting and transforming means, consisting of a motor located in the space defined by the cover 16'''.

FIG. 4 shows a construction embodiment of the main switch machine according to this invention and to the above disclosure. In FIG. 4, dashed and dotted lines outline the modules and the corresponding means associated thereto.

The main switch machine has, like in FIG. 3, a channel case 15, which has the function of a track tie and may be installed instead of a tie. At opposite ends, the main switch machine has plates coincident with the rails 4, 5, not shown in detail, and secured to the channel case 15, e.g. to the lateral longitudinal flanges 115, by bolts or other fasteners. A vertical threaded pin 20 branches off the plates, outside the corresponding rail 4, 5, the fastening base 121 of a rail locking element 21 being fitted on said pin. The locking element 21 has a vertical extension 221 which is supported in a cantilever fashion toward the corresponding rail 4, 5. The vertical extension 221 has a wedge shape, corresponding to the flared I shape of the rail 4, 5 and may be secured by one or more threaded pins 22 and nuts 122 against the corresponding rail 4, 5 in a position in which it is wedged in the flared recesses of the section of the rail. This provides accurate, self-centering and clearance-free positioning.

The switch points 1, 2 are disposed between the two rails 4, 5 and are secured by means of two joints, generally denoted 23, to the upper end of one of two vertical rods 24 respectively, which project out of the switch machine and at least one or both of which are removably secured by means of screw fasteners 25 to a point operating rod 26 and to a control rod 38 of a point coupling and locking unit, generally designated as module 12. The functions of these rods will be described in further details hereafter. The screw fastener means 25 are disposed in such a position that their heads 125 are accessible from the outside.

Figure 5:
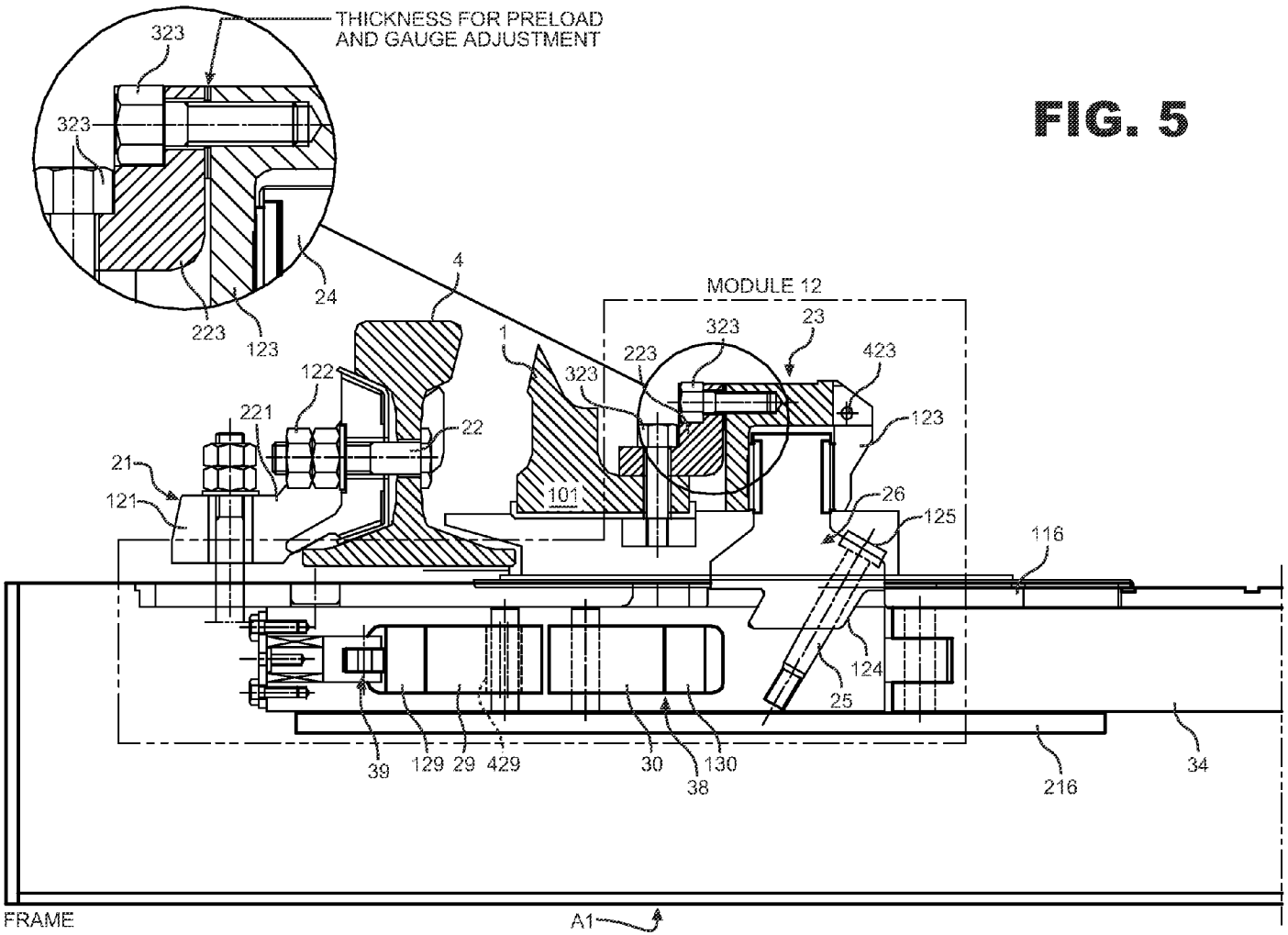
FIG. 5 shows an enlarged detail of FIG. 4 of the area of module 2, i.e. of the coupling and point locking units of one of the two points.

The main switch machine as shown in FIGS. 4 to 6 has two modules 12 for each switch point 1, 2, each of which modules 12 includes dedicated point coupling and point locking units for each point 1 and 2 associated thereto, said module being located in a portion of the channel case 15 which substantially corresponds to the position of the rail 4 and 5 and the corresponding switch point 1 and 2. Furthermore, each module 12 has a separate case 16 for housing the point coupling and locking units, whereof the upper and lower walls 116, 216 and the side walls 316, 416 are visible in FIGS. 4 to 6 respectively, said module 12 being completely closed, except for the steps required for coupling it to other operating units, to be described hereafter, and to the corresponding points 1, 2.

Moreover, particularly the plates secured to the rails 4, 5 may be formed by the upper wall of the case containing the modules 12 which is in turn secured, as described with reference to FIG. 3, by the side edges oriented in the longitudinal direction of the channel case 15, to the lateral longitudinal flanges 115 of said channel case 15.

Therefore, each module 12 has a unit for coupling it to the corresponding point, which consists of removable vertical rods 24 and the joints 23 for connection of said rods 24 to the point and advantageously two vertical rods 24 are fastened at two spaced locations in the longitudinal direction of the corresponding point 1 and 2.

Referring now to FIG. 5, which shows an enlargement of one of the ends of the switch machine, at one rail 4 and the associated switch point 1, each joint 23 comprises a cup-shaped terminal 123, in which the free upper end of the corresponding vertical rod 24 is fitted, which cup-shaped terminal 123 is secured to the point by means of an L-shaped plate 223, which is fastened by fastener means 323, such as bolts or the like to the cup-shaped terminal 123 and to the base 101 of the point 1.

As is further apparent from FIG. 5, the cup-shaped end of the joints 23 which connect the switch point 1 to the control rod 38 and to the point operating rod 26 is formed in such a manner as to disengage from the head of the associated vertical rod 24 when the switch point 1 is forced to perform a point displacement motion relative to the vertical rod. Preferably, to this end the invention provides means for predetermined breaking disengagement. Particularly, the cup-shaped end 23 which connects the switch point 1 to the vertical rod 24 associated to the control rod consists of a tubular element which is upwardly closed by a transverse wall which lies over the end of the vertical rod 24. Said wall that closes the cup-shaped end is connected by its tubular portion, by means of a pin or the like, which is appropriately weakened to form a mechanical fuse that is breakable when the load on the switch point, i.e. exerted by a train in the switch trailing condition, exceeds a predetermined maximum limit, defined by the breaking strength limit of said pin, denoted 423. The function of this breaking action and of the two control and point operating rods will be more apparent hereafter.

The switch point lock unit will be described with reference to that associated to the point 1, the unit associated to the point 2 being identical to it. Said unit comprises the point operating rod 26, which is dynamically connected to the point 1, and is held between a side wall 316 of the case 16 of the module 12 and a slider 27.

The point operating rod 26 carries two opposed latches 29 and 30, which have opposed lugs for engagement with associated abutment surfaces 227, 327 or recesses 516, 616 for respective engagement on the slider 27 and the side wall 316 of the case of the module 12 along which the point operating rod 26 slides. The driving slider 27 also has means for causing engagement and disengagement of the latches 29 and 30 with the associated abutment surfaces 227, 327 or recesses 516, 616 for respective engagement on the slider 27 and the side wall 316 of the case of the module 12 along which the point operating rod 26 slides. These means consist of combinations of rollers and cams, which cause the latches 29 and 30 to be displaced as a function of the displacement of the slider 27, caused by a portion of an actuating rod 34, which is interposed between the point lock units of the two modules 12 associated to the two points 1, 2, and which is dynamically connected by each of its ends to the driving slider 27 of the corresponding point lock unit of the corresponding module 12.

The actuating rod 34 is carried in the two throwing directions of each of the two switch points 1, 2, toward the corresponding rail 4, 5 by a unit for transmitting/transforming the motion produced by the actuating motor, which is a part of an additional prefabricated module, to be described in greater detail hereafter.

Any well-known construction used in the art may be provided for the point lock units. Nevertheless, the figures show a particular simple embodiment of the point lock unit contained in the module 12.

In this embodiment, and as shown in FIGS. 4 to 6A, 6B and 7A, 7B, the point operating rod 26 carries two latches 29 and 30, which are supported in such a manner as to swing in the horizontal plane to and from the side wall 316 of the case of the module 12 and the slider 27. The latches 29 and 30 have two opposed latching lugs 129 and 229, 130 and 230, projecting out of the two opposed sides, i.e. turned toward the side wall 316 of the case of the module 12 and the slider 27. One of the two opposed lugs 120, 130 cooperates with an associated latching recess 516, 616, formed in the corresponding vertical wall 316 of the case of the module 12, for primary and secondary switch point locking actions. The other of the two opposed lugs 229, 230 of the two latches 29 and 30 cooperates with an associated abutment surface 227, 327 on the slider 27 to cause the slider 27 to pull or push the point operating rod 26.

The slider 27 has a roller 31 on the side turned toward the latches 29, 30, which adheres against a cam surface formed on an extension of said latches 29, 30 and controls displacement thereof. Particularly, the latches 29, 30 have a T shape, in which the two halves of the transverse stem form the opposed lugs 129, 130 and 229, 230, whereas the base stem 329, 330 is shaped like a cam on the side turned toward the slider 27 and cooperates with the roller 31 carried thereby. The T-shaped latches 29, 30 are pivoted about a vertical axis at the end of the base stem 329, 330, which extends to a certain extent beyond the fulcrum in such a manner that the roller cooperating with the cam track on said end portion of the base stem 330 beyond the fulcrum, may cause the latches to swing toward the slider 27 and to a condition of disengagement thereof from the latching recesses 516, 616 in the side wall 316 of the case of the module 12.

Particularly, the shape of the cam track on the base stems 329, 330, formed by the side surfaces of said base stems turned toward the slider 27, the overall length of the two opposed lugs 129, 229 and 130, 230 and the inclination of the end sides are selected in such a manner that, when the latches 29, 30 are in either engagement position, with the wall 310 or the slider 27, the other end surface of the opposed lug extends in a position of non-interference with the slider 27 or the wall 316. The base stems have a widening shape toward the fulcrum end, with two divergent opposed edge portions, whereas the edge turned toward the slider 27 and the control roller 31 is inwardly inclined substantially level with the diameter that cuts the pivot or fulcrum hole along a bisector of the angle formed by the divergent stem edge portion. While the latch 30 is pivoted in a clearance-free manner and performs a primary, rigid switch point locking action in its respective thrown or open positions relative to the associated rail, the latch 29 performs a secondary switch point locking action and is pivoted in a slotted hole, for reasons to be better explained below in the description. A preload presser 39, comprising a roller 139 and adjustable means for pushing the roller 39, interacts by said roller against the end side of the T stem of the latch 29, which has an arched shape, to keep the latter in a locked position within the recess 516, in such a manner as to lock the switch point 1 in the thrown position. Otherwise, the latch 29 would not be stably engaged in the recess 516, due to the translational motion on the fulcrum caused by the slotted hole 449.

Figure 6A:
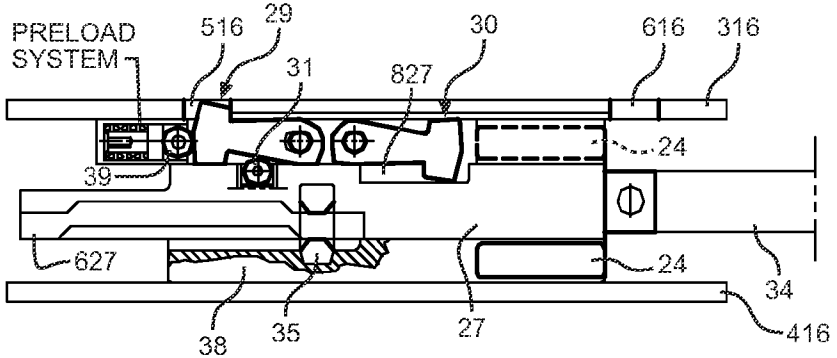
FIGS. 6A, 6B, 6C, 6D are respective views of the switch point locking means, associated to the two points of a switch in the main switch machine and two partly sectional top plan views as taken along two different horizontal planes of the two units of the switch machine as shown in FIGS. 4 and 5.
Figure 6B:
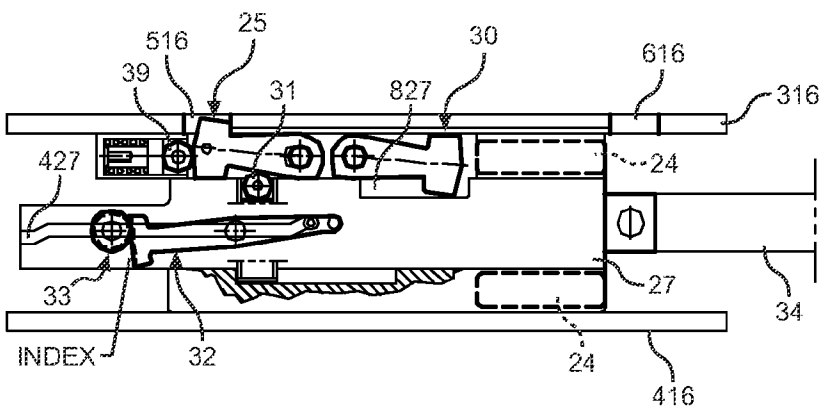
Figure 7A:
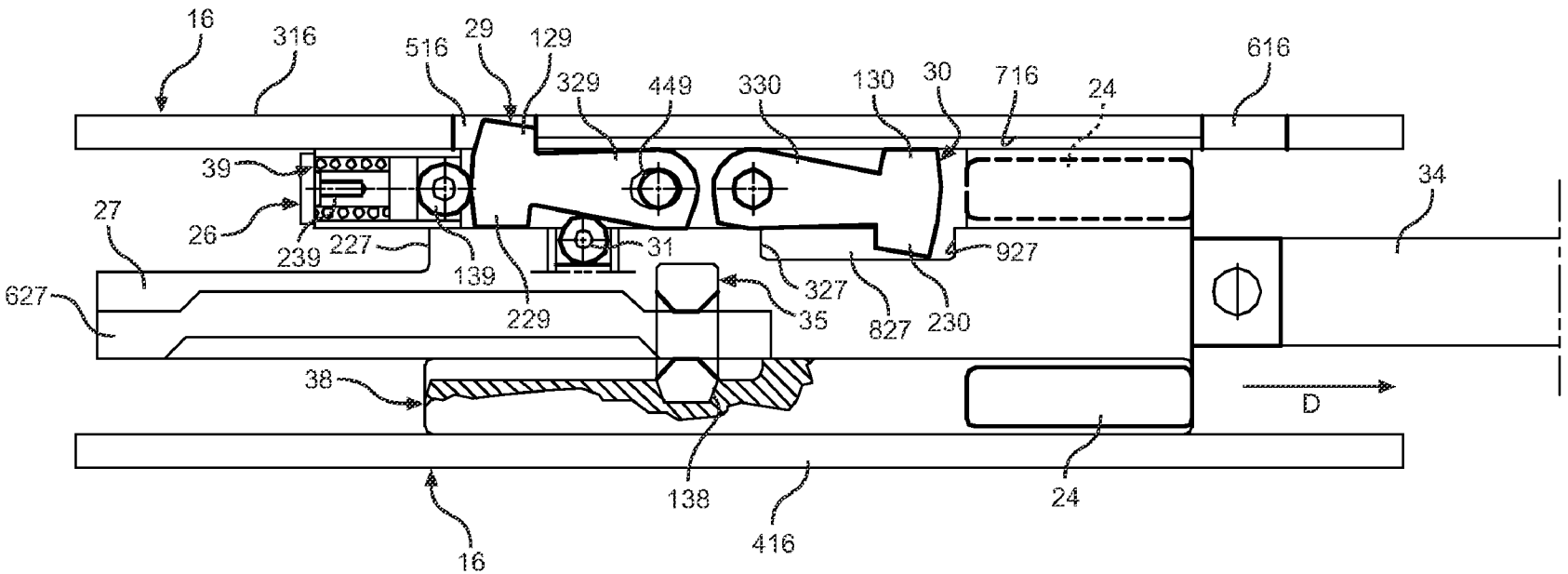
FIGS. 7A and 7B are enlarged views of FIGS. 6A and 6B.
Figure 7B:
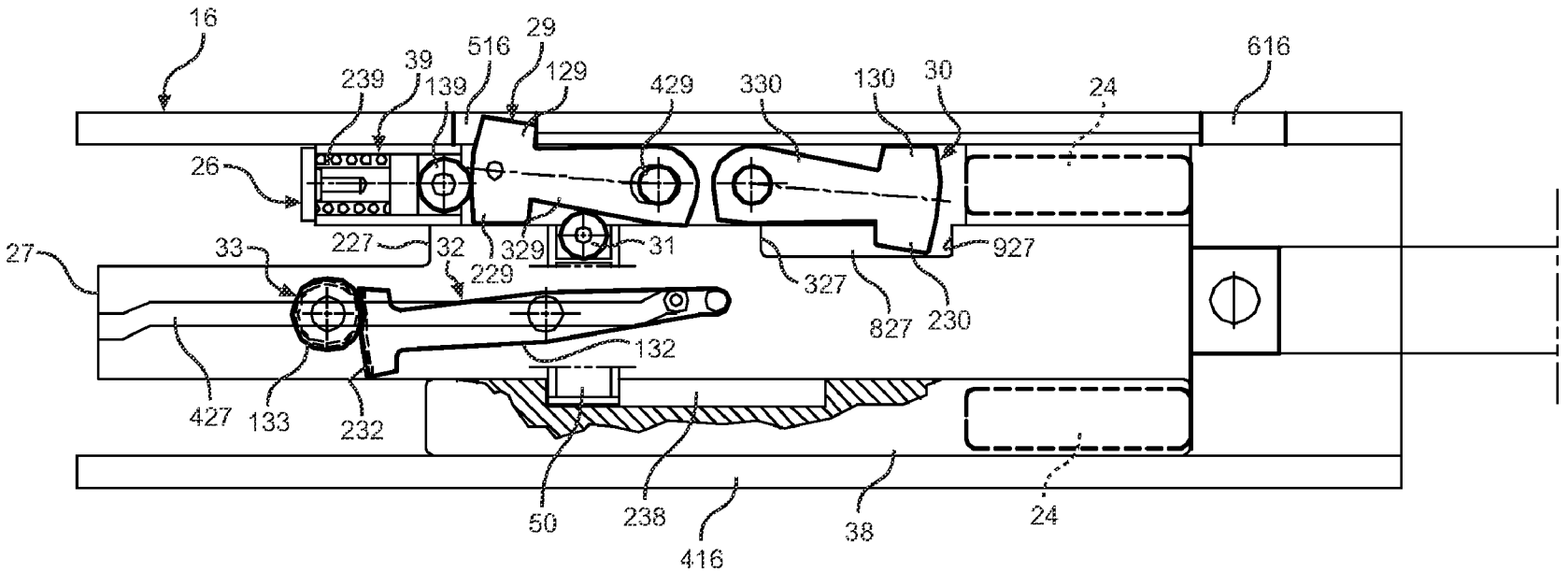

Also, as is apparent from FIGS. 6B and 7B, each slider 27 has a particular cam track 427, which extends in the slider displacement direction, wherein a spindle 132 carrying a sector gear 232 is engaged by two spaced rollers, which spindle 132 is a swinging member 32 for controlling a controller unit 33 driven by a gear 133 engaged with said sector gear 232. The swinging motion of the sector gear 232 caused by the two rollers engaged in the cam track 427 and the shape of said cam track cause the rotation of the gear 133, which in turn drives a shaft for switching electrical switches which generate control signals about the operating condition of the switch machine.

The control rod 38 is located between the slider 27 and the side wall 416 of the case 16 of the module 12, which wall is opposed to the wall 316 associated to the point operating rod. The control rod 38 has a transverse recess 138 for engagement of a tooth 35 which is carried by the slider 27. The tooth 35 has an intermediate opening with trapezoidal opposed edges, by which it engages on a cam track 627 of the slider 27, which causes it to slide transversely to a position of engagement with or disengagement from the transverse recess 138 of the rod 38, the mounted tooth 15 being unable to be displaced in translational motion with the slider 27, but only in free motion transverse to the slider 27, thanks to the cam track 627. The tooth 35 has the function of alternately slidably coupling or uncoupling a plate, not shown in detail, which carries the central pivot of the pivotal control arm 32, to allow a loss of control to be generated as a result of a trailing action, as described in greater detail hereafter.

Figure 8:
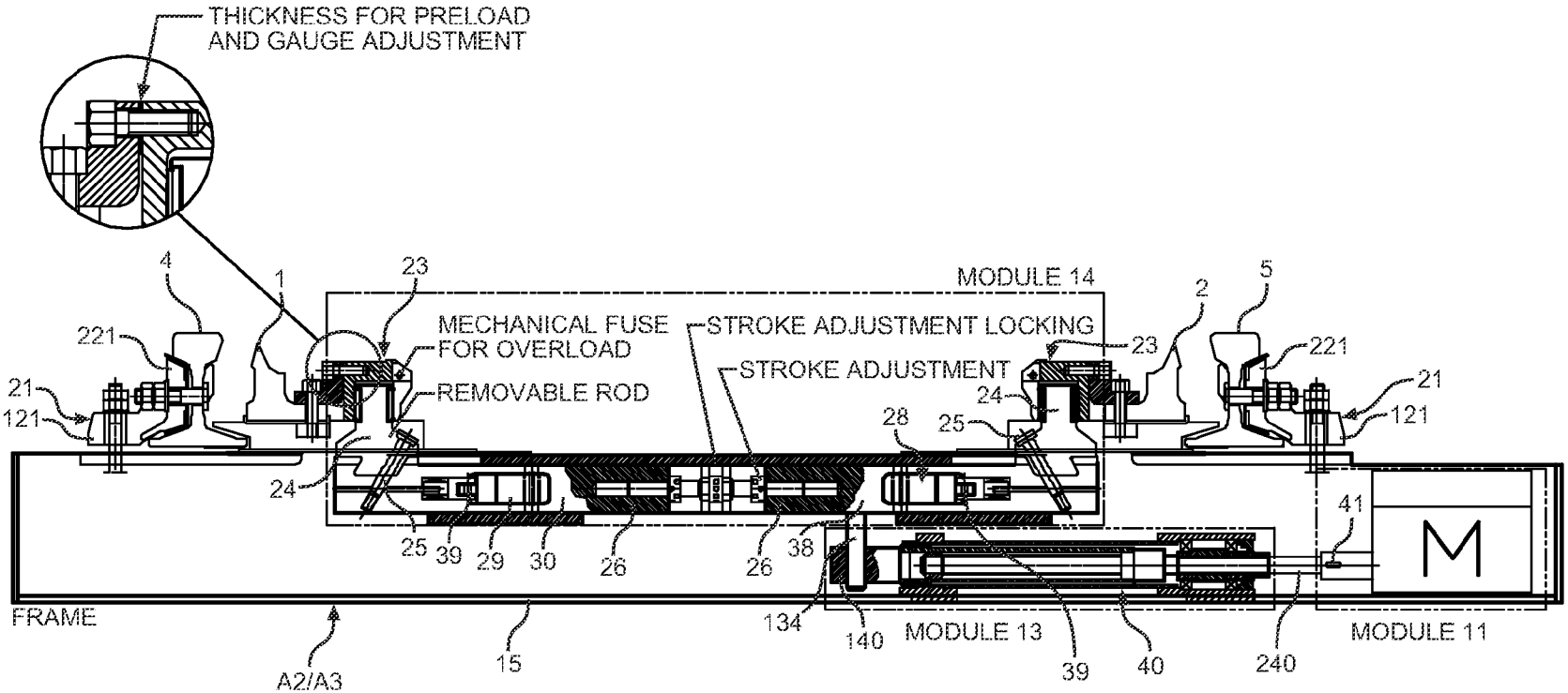
FIG. 8 is a view similar to FIG. 4 of a switch machine for an intermediate portion of the points.

With further reference to FIG. 8, the displacement of the point operating rod 34 is controlled by a motion transmitting/transforming unit which is a part of and is housed in a module, denoted 13. Said unit substantially comprises means for transforming rotary motion into rectilinear motion, which are generally denoted 40, and consist, for example, of a combination of a threaded spindle and a threaded bush, or of a linear ball bearing actuator, or the like. Thanks to a coupling extension 134, the rod 34 is dynamically connected to the motion transforming unit 40. This unit is driven by a motor unit, e.g. an electric motor M, which is housed in the module 11 and is connected by its output shaft to the input shaft 240 of the motion transforming unit by means of a joint 41.

Upon normal actuation of the switch machine A1, the motor is actuated and the rotary motion is transformed into rectilinear motion by the transmission of the module 13. This rectilinear motion displaces the point operating rod 26 to move the switch point 1 away from and/or toward the rail 4, the contrary being provided for the switch point 2 and the rail 5. As is apparent from the combination of FIGS. 4 to 7B, the slider 27 may move to a certain extent in the direction of arrow D until the lug 230 of the latch 30 cooperates with the abutment surface 327 of the slider 27. In this condition the slider 27 starts to exert a pulling force on the point operating rod 26. The initial free displacement of the slider 27 until the surface 327 abuts against the lug 230 of the latch 30 also causes the tooth 35 of the control rod 38 locked against the slider 27 to be displaced to a position in which said control rod is released from the plate that carries the swinging arm 32 that drives the controller means 33. The control rod 38 is slidably coupled with the slider 27 by means of a tooth 50, which projects into a recess 238 of the control rod 38 and alternately abuts against the ends of said recess 238. The two point operating and control rods 26 and 38 move together with the slider 27 and the switch point 1. This may be due to the fact that, during the initial free stroke of the slider 27, the roller 31 rolls along the cam-like edge of the base stem 329 of the latch 29 and the cam-like edge of the base stem 330 of the primary point locking latch 30, and reaches an intermediate position therebetween, i.e. a position in which it adheres to the end portions of both base stems of the latches 29, 30, thereby causing them to simultaneously swing to disengagement of the two latches 29 and 30 from the recesses 516, 616 in the wall 316. Obviously, the point lock unit associated to the opposite point performs a reverse movement, according to the same principles.

Figure 6C:
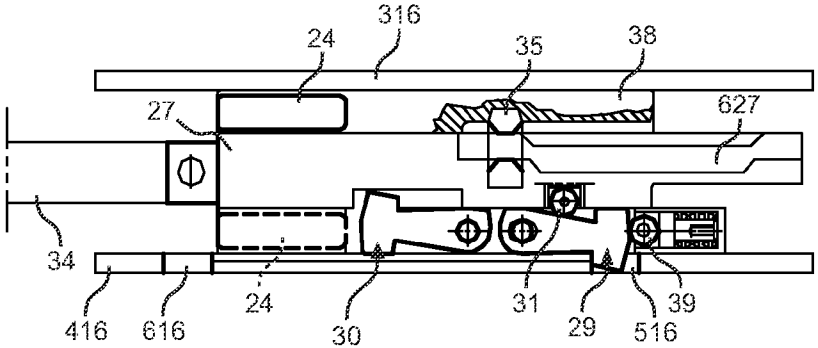
Figure 6D:
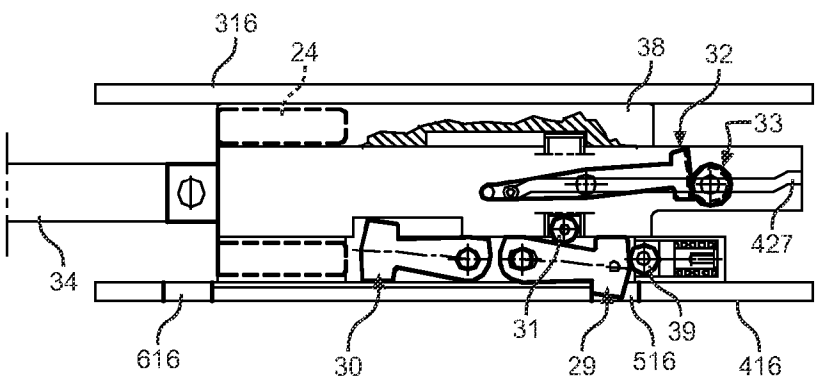

The assembly formed by the slider 27 and the point operating and control rods 26, 38 runs its stroke to throw the switch point 2 against the rail 5, in which said identical point locking means reach the position as shown in FIGS. 6C and 6D, whereby the switch point 2 is locked in a thrown position against the rail 5.

The thrown position of the switch point 2 against the rail 5 is reached before the end of the stroke of the point operating rod 34. Such stroke difference corresponds to the length of the recess 827 in the slider 27, which form the abutment surface 227 for the point operating rod 26. Therefore, when the switch point 2 reaches the thrown position against the rail 5, the associated latches 29 and 30, carried by the point operating rod 26 for the point 2, stop in a position which coincides with the recess 516 in the wall 316 of the case 16 of the corresponding module 12 and with the recess 827 of the slider 27. The rest of the stroke will carry the latch 30 from the abutment position against the surface 327 of the slider 27, associated to the switch point 2, to the position of engagement of the lug 130 of the primary point locking latch 30 in a recess 516, 616 for engagement of the case 16. Also, said independent end portion of the stroke of the slider 27 associated to the switch point 2 will carry the tooth 35 to engagement in the recess 138 of the control rod 38 for the point 2, thereby restoring the sliding link between the pivotal arm 32 which drives the control means including the control rod 38. Regarding the switch point 1, the independent end stroke of the slider 27 associated to said point 1 spaced from the corresponding rail will cause the latch 29 to be moved to a position of engagement of the lug 129 in the recess 516 of the wall 316, thereby generating the secondary switch point 1 locking condition, which is at the end of stroke position, spaced from the rail 4. Conversely, the coupling tooth 35 of the control rod associated to the switch point 1 will remain disengaged from the control rod 38.

It shall be noted that the point operating rods 26 for the two points are separately linked to the corresponding sliders 27 and to the actuating rod. This is highly important for the trailability feature.

When the switch is trailed, i.e. when one of the thrown switch points is pushed away from the corresponding rail by a train wheel, the above described switch point locking means, which are contained in the modules 12 associated to each point 1 and 2, allow the point to be released from the point locking means without affecting the position of the opposite point, and the functions thereof.

The trailability of this switch machine is based on mechanical fuses, i.e. mechanical elements which are arranged to break or be deformed when they are subjected to a predetermined mechanical stress.

Figure 9:
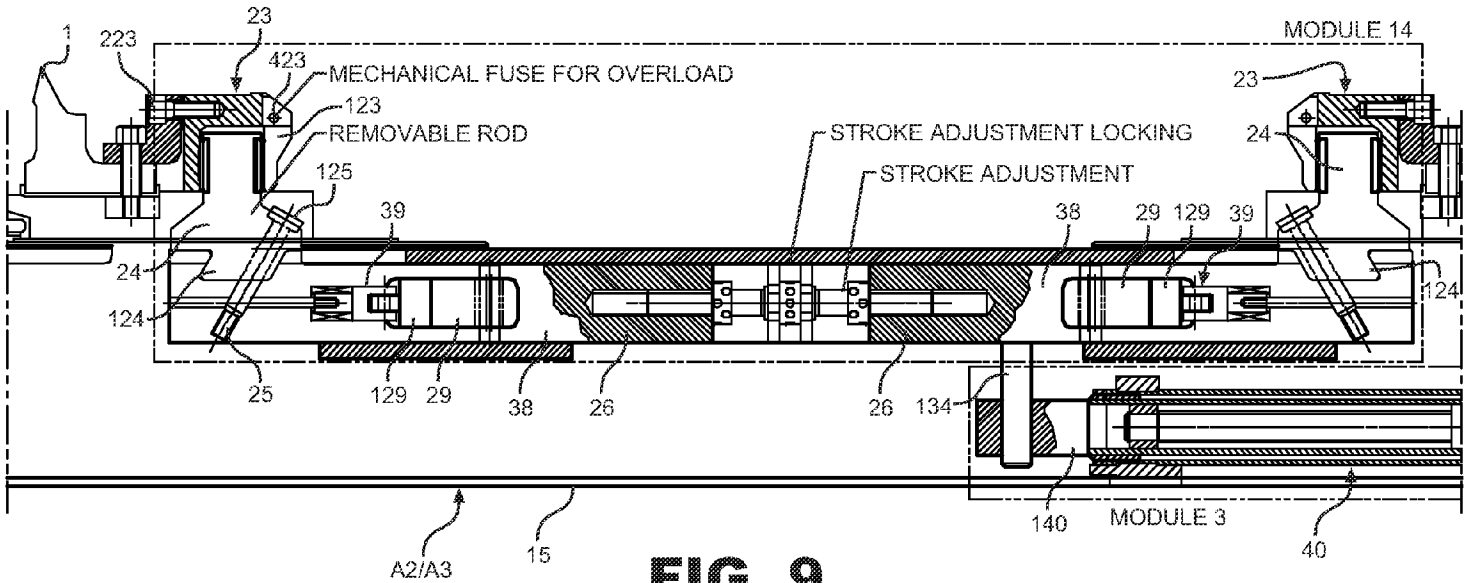
FIG. 9 shows an enlarged detail of the switch machine as shown in FIG. 8, i.e. the coupling and point locking module.

With reference to FIG. 9, the force exerted by the train wheel upon trailing first causes the pin 423 of the joint 23 for coupling the point operating rod 26 to the thrown point to break, whereby the trailed point moves freely relative to said point operating rod 26, which is in an active primary point locking position, i.e. with the latch 30 being supported in a clearance-free position, engaged in the latching recess 516 of the case 16 of the module 12.

The trailing force is elastically taken up by the secondary point locking latch 29, thanks to the clearance on the pivot due to the slotted hole 429 and to the elastic preload means 39.

However, the joint 23 which secures the trailed point to the control rod 38 is not immediately broken. This joint is displaced and carries with it the pivotal arm 32 which drives the control means, as the tooth 35 is not disengaged. Therefore, the swinging arm 32 is carried in a no-control position, thereby signaling the trailing condition.

The control rod 38 continues its free stroke until it reaches a stop, and in this condition the trailing action causes the joint 23 that connects the control rod 38 to the thrown point to be broken.

When the joints 23 for coupling the point to the point operating rod 26 and the control rod 38 are broken, the point locking means associated to the switch points 1, 2 are not subjected to improper stresses, and the point locking system is fully operational, whereas full switch functionality may be restored by replacing or restoring the broken joints 23.

Figure 10:
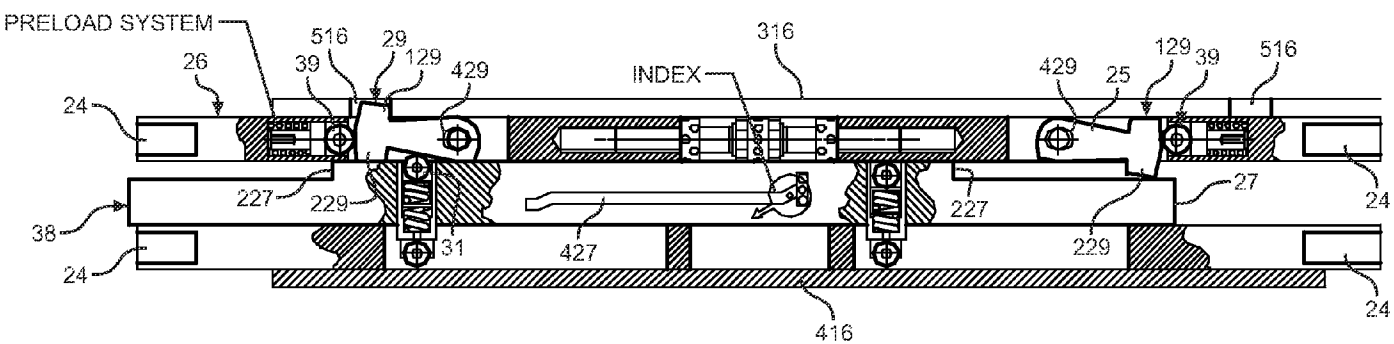
FIG. 10 is a partly sectional plan view of the coupling and point locking module.

FIGS. 8 to 10 show, like FIGS. 4 to 7, the intermediate switch machine, denoted A2, A3. It shall be noted that the modules 11 and 13 in the channel case 15, are exactly like in the previous embodiment of the main switch machine A1. Instead of two separate modules 12 including point coupling and point locking means, the intermediate switch machine has a point coupling and locking device between the two points 1, 2 and the associated rails 4, 5. The operating principle is substantially identical, and like functional parts, or parts having like constructions will be designated with like numerals.

The module 14 contains point 1, 2 coupling and locking means. Unlike the arrangement of the main switch machine, no separate point locking means are provided for the points 1, 2. The two points 1, 2 are connected to a common point operating rod 26, through vertical rods 24 and the joints 23. Hence, the point operating rod 26 controls both points 1, 2 and carries a latch 29, having the trailability features as described with reference to the embodiment of FIGS. 4 to 7B, i.e. a clearance in the sliding direction of the point operating rod 26, at the respective end portions, in combination with preload means 39. Each of the two latches 29 is controlled by a roller 31, which is housed in an elastically compliant manner in a common control rod 38, which forms, at the two opposite ends, surfaces 227 for engagement with the lugs 229 of the latches 29, in the corresponding thrown positions of the points 1 and 2 against the corresponding rails 4, 5. The control rod 38 has a cam track 427 for driving control means 33, which may be identical to the control means of the previous embodiment.

The slider 27 is connected to the transmission means, which form a module 13 identical to that of the previous embodiment, and are driven by a motor, in the form of a module 11 identical to the one of the previous embodiment.

Upon normal actuation of the intermediate switch machine, the initial independent and idle displacement of the slider 27 causes the control rod 38 and the rollers 31 to be displaced along the point operating rod, to drive the latches 29 into disengagement from the latching recesses 516 and into engagement of the surfaces 227 or 327, which allow the point operating rod 26 to be entrained by the slider 27. Any further motion, for instance to throw the opposite point 2 against the rail 5 causes the abutment surface 227 turned toward the latch 29 on the side of the point 2, to abut against the lug 229 of said latch 29, and the point operating rod 26 to start the simultaneous displacement of both switch points 1, 2. The stroke of the point operating rod 26 ends in the thrown position of the point 2 against the rail 5, whereas the control rod may still run a short end stroke, like in the previous embodiment, which stroke causes the roller 31 to act against the latch 29, on the side of the thrown point 2 against the rail 5, which latch was stationary at the opening and is then displaced to engagement therein, thereby locking both points 2 and 1.

Like in the previous embodiment, as shown in FIGS. 4 to 7B, the control rod 38 and the point operating rod 26 are connected to the switch point by means of a predeterminedly breakable joint 23. Therefore, if the switch is not actuated in the right direction, i.e. to throw the point 2 against the rail 5, but it is actuated by a train wheel that trails the point 1 that is thrown against the rail 4, the joint 23 connecting the point operating rod 26 to the points is broken, and the control rod 38 is displaced and enters a condition in which it loses the control of the switch machine and, once the control rod reaches an abutment, the joint 23 connecting this control rod to the trailed point is also broken, to allow free point motion.

Like in the previous embodiment, the provision of a clearance in the construction of latches and the preload means allow to take up the trailing stress thereon, thereby avoiding damages to the switch point lock system.

Obviously, while the previous embodiment relates to the displacement from the thrown position of the point 1, either due to actuation of the switch machine or due to trailing, the same identically applies to the displacement from the thrown position of the point 2, either due to actuation of the switch machine or due to trailing.

Regarding the switch machine A4 or A5 for the switch frog 3, the construction thereof is substantially identical to the one described for intermediate switch machines A2 and A3.

Again for switch machines A2 to A5, it shall be intended that the embodiment described above is only a specific example that includes all possible features, particularly regarding trailability. The principle of modularity of this invention shall be intended without particular reference to the construction embodiment as shown above, even though such embodiment includes improvements that allow a better construction of operating units as modules, while providing all the features required from a switch machine.

Therefore, alternative embodiments might also be provided, in which the switch machines have non-trailable switch locking devices, and this applies to all switch machine types A1 to A5, even by simply providing structural changes to the devices described above. In fact, by providing latches 29 identical to latches 30, and by omitting predeterminedly breakable joints between the switch points and the control rod, the switch machines as described and illustrated herein become of the non-trailable type.

What is claimed is:

1. A switch machine for a rail transport switch comprising:

a plurality of modules including a motor module, a transmission module, and one or more separate point coupling and locking coupling modules, each of the plurality of modules having a case with an open upper face; and an enclosure having the form of a rail tie and containing at least some of the cases of the plurality of modules, the enclosure having an upwardly oriented channel shape closed by an enclosure cover and lateral longitudinal flanges with flange openings therein, each of the at least some of the cases including means for fitting the case within the enclosure in a predetermined position, wherein the cases further comprise case openings coincident with the flange openings for fastening the cases therethrough, and wherein the enclosure cover is formed by one or more covers of the upper faces and by one or more additional covers.

2. The switch machine of claim 1, wherein the case of each of the plurality of modules includes apertures allowing passage of means for connecting input or output members of other modules or operating units, the apertures having mating shapes with the input or output members and being placed in predetermined positions.

3. The switch machine of claim 1, wherein the switch machine is comprised in the rail transport switch which has switch points that comprise point heels and a switch frog, the switch machine being a switch machine for the point heels, a switch machine operating in an intermediate position along switch points, or a switch machine operating at the switch frog, and wherein the rail switch comprises at least one switch machine for the point heels, at least one switch machine operating in an intermediate position along switch points, and at least one switch machine operating at the switch frog.

4. The switch machine of claim 3, wherein the switch machine for the point heels, and the switch machines operating in the intermediate position and at the switch frog, have identical motion transmitting and transforming modules, identical enclosures, and different point coupling and locking modules.

5. The switch machine of claim 4, wherein the switch machine for the point heels differs from the switch machine operating in the intermediate position and from the switch machine operating at the switch frog by having two point coupling and locking modules, each of the point coupling and locking modules being associated to one switch point for separate point locking action.

6. The switch machine of claim 5, wherein the switch machine operating in the intermediate position is shared by two switch points and is interposed therebetween.

7. The switch machine of claim 4, wherein the switch machine operating at the switch frog differs from the switch machine for the point heels and that is identical to the switch machine operating in the intermediate position.

8. The switch machine of claim 3, further comprising a diagnostic module.

9. The switch machine of claim 8, wherein the diagnostic module is essentially identical for the switch machine for the point heels, the switch machine operating in an intermediate position along switch points, and the switch machine operating at the switch frog.

10. The switch machine of claim 8, wherein the diagnostic module has an essentially identical case for the switch machine for the point heels, the switch machine operating in an intermediate position along switch points, and the switch machine operating at the switch frog, and wherein the case of the diagnostic module has a modular design housing a diagnostic unit.

11. The switch machine of claim 3, further comprising a diagnostic module having an essentially identical case regardless of whether the switch machine is employed for the point heels, operating in an intermediate position along switch points, or operating at the switch frog, and regardless of a diagnostic unit contained therein.

12. The switch machine of claim 1, further comprising a switch point;

wherein the one or more coupling and locking modules comprise, a point operating rod connected to the switch point and structured for displacing the switch point; and a control rod also connected to the switch point and parallel to the point operating rod, the control rod generating switch state controls, wherein the point operating rod and the control rod are connected to the switch point with a joint breakable when a predetermined trailing force is exceeded, and wherein the point operating rod includes latches disposed such that one of the latches automatically and rigidly engages one of a plurality of latching recesses formed in a stationary wall of the enclosure, thereby causing the latches to provide a point-locking function.

13. The switch machine of claim 12, wherein the stationary wall is a side wall of the enclosure.

14. The switch machine of claim 12, wherein the latches comprise a primary point locking latch and of a secondary point locking latch.

15. The switch machine of claim 14, wherein the switch point is displaced by causing the point operating rod to translate the primary and the secondary point locking latches along a desired direction of displacement of the switch point.

16. The switch machine of claim 14, wherein the primary and the secondary point locking latches are rotatable in relation the point operating rod during translation of the point operating rod, further comprising a preload presser engaging the secondary point locking latch such to retain the switch point in a thrown position when the secondary point locking latch engages one of the plurality of latching recesses.

17. The switch machine of claim 16, wherein the translation is transmitted to one or more of the point operating rod or the control rod by an intermediate slider disposed between the point operating rod and the control rod, the intermediate slider having a linear motion provided by a unit transforming a rotary motion provided by a motor into the linear motion.

18. The switch machine of claim 17, wherein the intermediate slider carries means for driving the primary and the secondary point locking latches, wherein the means for driving comprise a combination of cams and rollers alternately displacing the primary or the secondary point locking latch into an active point locking position, in which one of the primary or secondary point locking latches engages one of the plurality of latching recesses and further in which the other one of the primary or secondary point locking latches abuts against an abutment surface and causes an engagement of the intermediate slider with the point operating rod.

19. The switch machine of claim 17, wherein the intermediate slider actuates a member driving switch machine state control means.

20. The switch machine of claim 19, wherein a movement of the intermediate slider causes the control rod to be alternatively connected or disconnected to the member driving switch machine state control signaling means.

21. The switch machine of claim 20, wherein the switch machine state control means comprise a first gear, wherein the member driving the switch machine state control means comprise a pivotal arm and a sector gear engaging the first gear of the switch machine state control means, wherein the pivotal arm is hinged onto a slidable plate that is mechanically connected to and disconnected from the control rod upon the translation of the intermediate slider, and wherein a roller longitudinally spaced from a pivot hinging the pivotal arm causes a pivotal motion of the pivotal arm, the roller reciprocating within a slotted cam track defined within the intermediate slider.

22. The switch machine of claim 21, wherein the slidable plate is mechanically connected to or disconnected from the control rod by a transverse tooth translating within the slotted cam track, the transverse tooth engaging a recess in the control rod or disengaging therefrom, wherein, upon normal actuation of the switch machine, the control rod is not mechanically connected to the slidable plate, and wherein, upon displacement of the control rod due to a trailing action, the control rod becomes mechanically connected by the transverse tooth to the slidable plate and causes the member to disengage from the switch machine state control means.

23. The switch machine of claim 19, wherein, upon trailing, the point operating rod disengages from the switch point due to the joint breaking when the predetermined trailing force is exceeded, wherein, upon trailing, a sliding motion of the control rod is stopped by an abutment, and wherein the control rod is disengaged from the switch point only after running a limited displacement stroke of the member into a control loss condition.

24. The switch machine of claim 12, wherein there are two switch points each operatively coupled to one coupling and locking module.

25. The switch machine of claim 12, wherein there are two switch points sharing one coupling and locking module.

* * * * *